United States Patent [19]

Thiersch et al.

[11] 4,353,189

[45] Oct. 12, 1982

[54] EARTHQUAKE-PROOF FOUNDATION FOR COKE OVEN BATTERIES

[75] Inventors: Friedrich Thiersch; Manfred Strobel, both of Recklinghausen, Fed. Rep. of Germany

[73] Assignee: Firma Carl Still GmbH & Co. KG, Fed. Rep. of Germany

[21] Appl. No.: 152,539

[22] Filed: May 23, 1980

Related U.S. Application Data

[63] Continuation of Ser. No. 933,803, Aug. 15, 1978, abandoned.

[51] Int. Cl.[3] ..... C10B 5/00

[52] U.S. Cl. ..... 52/167; 202/222; 202/270

[58] Field of Search ..... 52/167; 202/270, 268, 202/224, 225, 226, 223, 222, 138

[56] References Cited

U.S. PATENT DOCUMENTS

| | | | |
|---|---|---|---|
| 1,427,078 | 8/1922 | Searle | 202/268 |
| 1,651,411 | 12/1927 | Porter | 52/167 |
| 1,761,559 | 6/1930 | Cummings | 52/167 |
| 1,761,660 | 6/1930 | Cummings | 52/167 |
| 2,208,053 | 7/1940 | Pinckard | 202/268 |

FOREIGN PATENT DOCUMENTS

| | | | |
|---|---|---|---|
| 10254 | of 1908 | United Kingdom | 52/167 |

*Primary Examiner*—John E. Murtagh
*Attorney, Agent, or Firm*—McGlew and Tuttle

[57] ABSTRACT

An earthquake-proof foundation for a lateral burner-type coke oven battery, comprising, a foundation baseplate connected to the ground, a mounting plate positioned above the baseplate for supporting the coke oven battery and a plurality of sliding devices interposed and connected between the mounting plate and the foundation baseplate to permit lateral and transverse displacement of the mounting plate with respect to the baseplate. The mounting plate includes a plurality of openings and ferroconcrete pegs are bonded to the foundation baseplate and extend upwardly into the mounting plate opening. Elastic elements are connected between the ferroconcrete pegs and the edges of their associated openings to resist transverse and lateral displacement of the mounting plate with respect to the foundation baseplate.

14 Claims, 11 Drawing Figures

1
2
3
4
4
5
6
6
6
6
6
7
7
7a
7a
8
8
8
9
9
10
10
11
12
13
14
15
15
16
17
18
II
III
II
III

EARTHQUAKE-PROOF FOUNDATION FOR COKE OVEN BATTERIES

This is a continuation of application Ser. No. 933,803 filed Aug. 15th, 1978 and now abandoned.

FIELD AND BACKGROUND OF THE INVENTION

This invention relates in general to coke oven batteries and, in particular, to a new and useful earthquake-proof foundation for so-called lateral burner-type coke oven batteries, which comprises a baseplate, a mounting plate and interpolated elastic elements effective in a lengthwise and crosswise direction to absorb horizontal displacement of the ground.

DESCRIPTION OF THE PRIOR ART

An earthquake-proof foundation is known from Japanese Pat. No. 743,738, in which elastic elements, effective in longitudinal and transverse directions are arranged between the baseplate and mounting plate polydirectionally movable stays and interlocked ferroconcrete ridges anchored in these plates and between the ferroconcrete ridges. This earthquake-proof foundation is suitable primarily for an oven chamber heater system equipped with underburners, i.e., burners in flues, which receive their fuel from the space between the base plate and the mounting plate, and from lines led through these mounting plates.

A wide spacing between the foundation plate and mounting plate is required for the arrangement of interlocked ferroconcrete ridges. A special design must be provided because of this arrangement of stays, and this results in the use of expensive materials. However, this cannot be avoided for an underburner equipped heater system since, for this purpose, an extended spacing between the foundation plate and carrier plate is required.

SUMMARY OF THE INVENTION

The object of the invention is to provide an earthquake-proof foundation for lateral burner-type heater systems, i.e., where fuel is fed laterally to flues, which requires less constructional work and no stays between the foundation and carrier plates, and which has a higher capacity to absorb horizontal ground oscillations.

The present invention provides for the arrangement of sliding devices between the foundations and the mounting plates which are effective in a battery for absorbing longitudinal and transverse displacement. Ferroconcrete pegs are also provided which are bonded to the foundation plate. These pegs project through openings in the mounting plate and elastic elements are provided between the pegs and the opening edges. The sliding devices can be in the form of cross-wise arranged double roller bearings.

Other forms of the sliding devices may be sheet metal layers which are inserted between the foundation plate and carrier plate, between which a sliding agent, e.g., flaky graphite, can be interpolated. A particularly reliable tested material for the layers is zinc. Laminated springs or pneumatic or hydraulic spring loads can also be used as the elastic elements between the opening edges and the pegs.

To reduce the heat transfer from the batery structure to the foundation structure to a minimum, the mounting plate is equipped with lengthwise ribs on its bottom. The interspacings between these longitudinal ribs represent ventilation channels with a cooling air stream sucked or pressed therethrough. Practicably, this cooling air stream is fed in on one side of the battery and is carried off on the other side by a venting chimney. In this way, the temperature differentials between the two plates can be limited to from 80° C. to 100° C. while, without this device, temperature differentials of between 150° C. to 200° C. are present. Thus, the thermal expansion of the mounting plate can also be kept within limits and, according to the invention, it amounts to about 30 mm, measured from the center of the plate in a longitudinal direction. This value is not exceeded under any conditions.

The pile foundation baseplates, the piles and sliding devices are arranged so that vertical forces are transferred to the pile heads directly via the sliding devices, i.e., the sliding devices are arranged directly above the piles. In this way, the bending load on the baseplate is reduced, and its steel reinforcement can be kept at a relatively low level.

For the ferroconcrete pegs bonded into the baseplate, it is practical to arrange them on the longitudinal sides of the battery, e.g., in $2\times8$ openings, where sufficient space for this is available on the bottom, beneath the accessible surface in the master passage. In this way, a uniform transfer of forces to the battery is accomplished, and also, the steel reinforcement of the mounting plate can be kept at a relatively low level.

If laminated springs are used between the pegs and opening edges as elastic elements, then the springs should be prestressed in order to absorb oscillatory amplitudes between 10 mm and 20 mm. Thereby, the springs themselves are selected so that maximum effective forces do not exceed 1/15th of the battery's own weight, since according to many investigations of earthquake damages, solid concrete and brickwork structures hold out only up to these set limits.

A practicable provision is to arrange cup and saucer springs and laminated cup springs by articulated attachment to their bases. This can be done, for example, via vertical rolls, which are in a position of balancing the mutually effective small-scale shift in foundation baseplate and mounting plate, produced by heatup and later temperature variations. The universal joint-type arrangement of rolls furthermore allows for a setting and resetting of the spring length. For this purpose, hydraulic presses are inserted betweeen the pressure plates of a universal joint roll. In this way, the spring is somewhat compressed and the supporting nut, which is seated on one side of the laminated spring, is then set to the required length. The hydraulic presses are subsequently relaxed and removed and the spring resumes operation.

Any spring length variations produced during the heatup time in connection with the heatup of the above laid mounting plate are constantly corrected by means of this resetting capability, so that even on reaching their heatup produced shifts, the laminated springs do not exceed their required length and/or prestress. The minor slanted position caused by the heatup-produced shifts has no detrimental effect because of the articulated rolls which are provided for the springs.

A buffer springs-type design is also feasible. In this case, conical helical springs as with railroad operations are used. These buffer springs have a hysteresis-loop rated curved characteristic. No excessive forces are produced on their initial compression. However, at the end of the spring lift, the forces required for compression are relatively high. On relaxing the spring, the frictions within the spring coils work themselves out in such a way that both diagram lines for compressing and releasing the spring differ from each other, and the spring always somewhat exceeds the tenion by more than that corresponding to the let-up load. Thereby, part of the energy stored in the spring is lost, which is effective as oscillatory attenuation.

The characteristic of buffer springs of having a high power stroke and a substantial compression even under the effect of relatively minor forces is also useful. A prestressing and absorbing of minor shifts and oscillations is thus feasible with only relatively minor force effect.

The roller bearings of the springs or other elastic elements, and the cross-roller bearings are advantageously arranged in tight sheet metal housings which are filled with grease. The sensitive parts are thus protected against contamination and corrosion which would otherwise be unavoidable during construction time as well as during later operations.

Supplementary features associated with such an extensively earthquake-proof foundation are a chimney smoke flue, which is elastically connected to the waste heat-carrying channels of the oven structure, e.g., by a steel gangway bellows, and in this way, does not lose its connection with the waste-heat channels beneath the battery if, according to the invention, any earthquake tremors are not followed up by the battery.

Accordingly, an object of the present invention is to provide an earthquake-proof foundation for a lateral burner-type coke oven battery, comprising, a foundation baseplate connected to the ground, a mounting plate above said baseplate, a plurality of sliding devices connected between said baseplate and said mounting plate for absorbing transverse and lateral displacement of said mounting plate with respect to said baseplate, said mounting plate including a plurality of openings, ferroconcrete pegs bonded to said baseplate and extending into said mounting plate openings, and elastic elements between said pegs and the edges of said openings for resisting transverse and lateral displacement of said mounting plate with respect to said baseplate.

A further object of the present invention is to provide an earthquake-proof foundation for a coke oven battery which is simple in design, rugged in construction and economical to manufacture.

For an understanding of the principles of the invention, reference is made to the following description of typical embodiments thereof, as illustrated by the accompanying drawings.

BRIEF DESCRIPTION OF THE DRAWINGS

In the Drawings

FIG. 7 is a partly in section lateral view of a cross-roller bearing design, taken along the line VII—VII of FIG. 8, in accordance with the invention;

FIG. 8 is a partly in section lateral view taken along the line VIII—VIII of FIG. 7;

FIG. 9 is a top plan view taken along the line IX—IX of FIG. 7;

DESCRIPTION OF THE PREFERRED EMBODIMENTS

Figure 1:
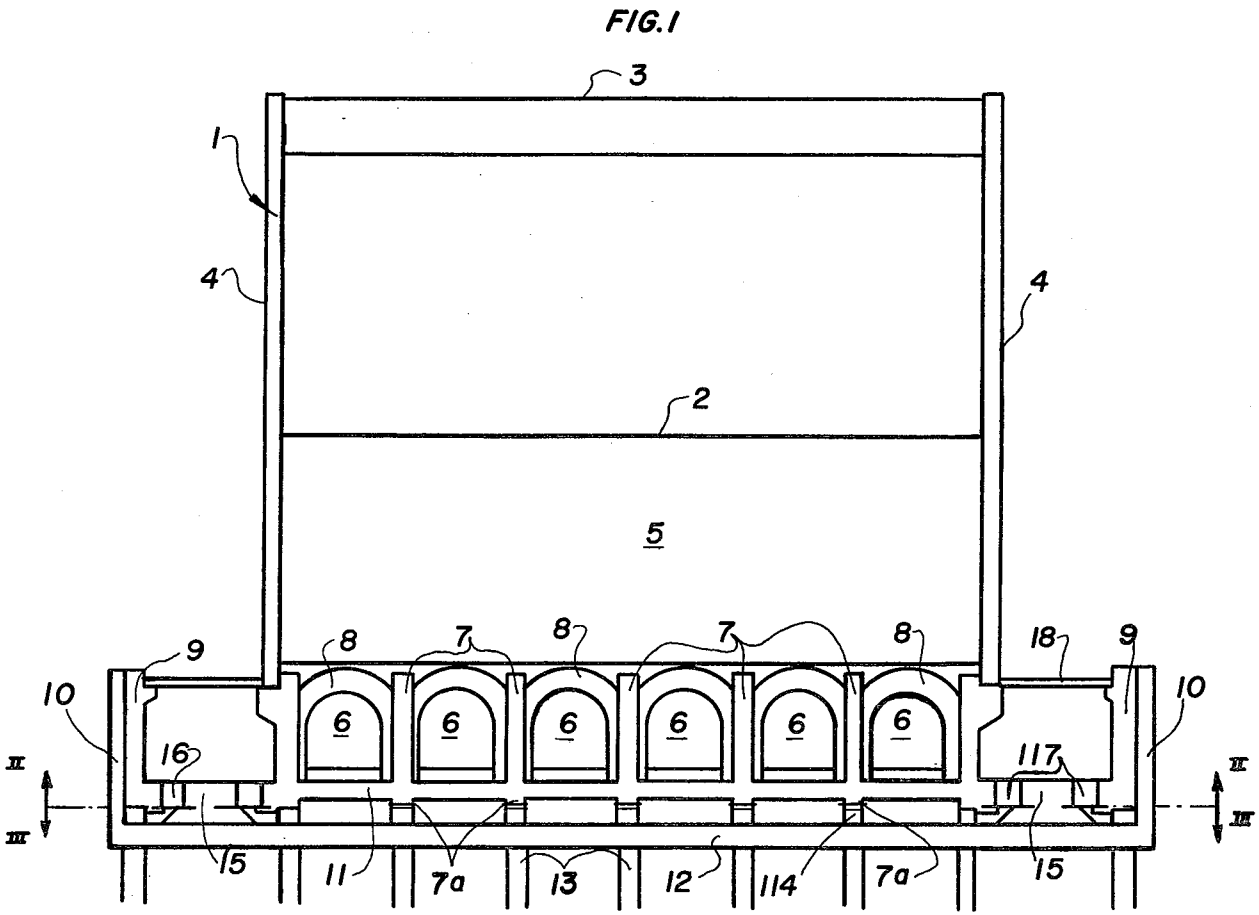
FIG. 1 is a side elevational sectional view of a coke oven battery taken along line I—I of FIGS. 2 and 3.

Referring now to the drawings in particular, the invention embodied therein in FIG. 1 comprises, a coke oven assembly, generally designated 1, of the lateral burner type. The coke oven assembly or battery 1 includes an oven- and/or battery bottom 2 with an oven- and/or battery ceiling 3. Anchor stands 4 extend on each long side of the coke oven battery 1 and define, with the coke oven bottom 2, the regenerators 5. The coke oven 1 includes flue-gas channels 6 which are defined between flue-gas channel walls 7 and, below flue-gas channel wall arches 8.

Figure 2:
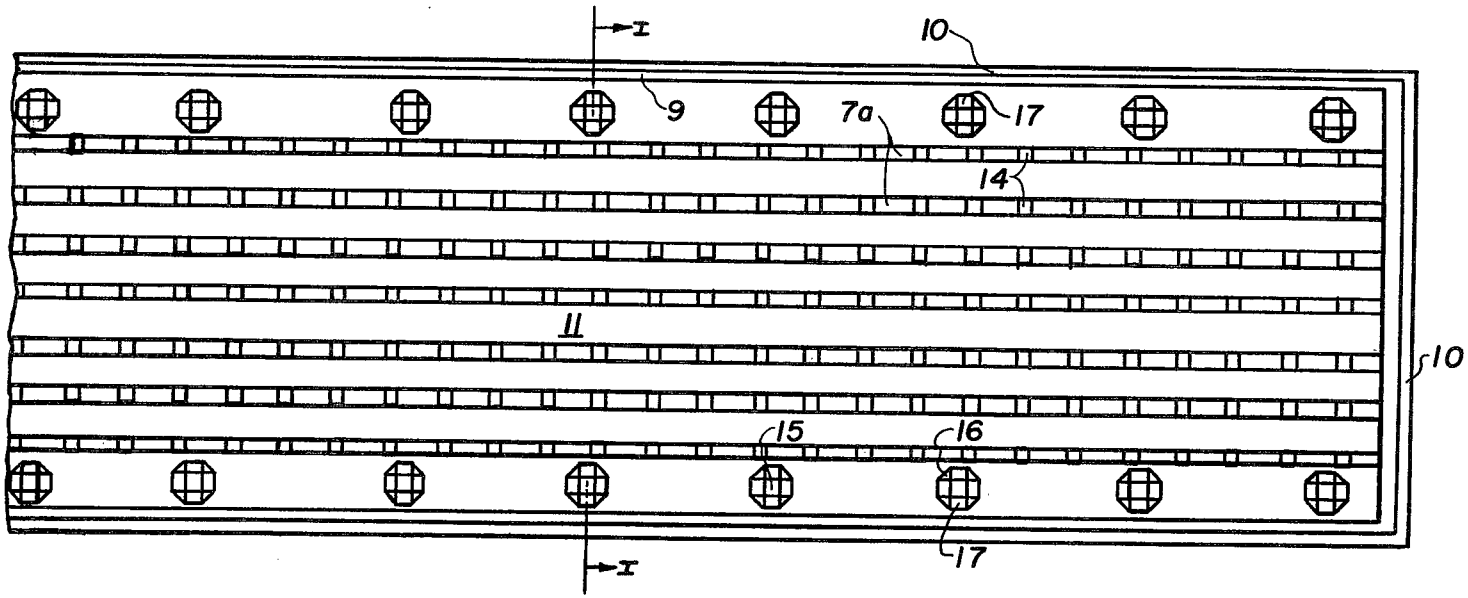
FIG. 2 is a view taken along line the line II—II of FIG. 1.
Figure 3:
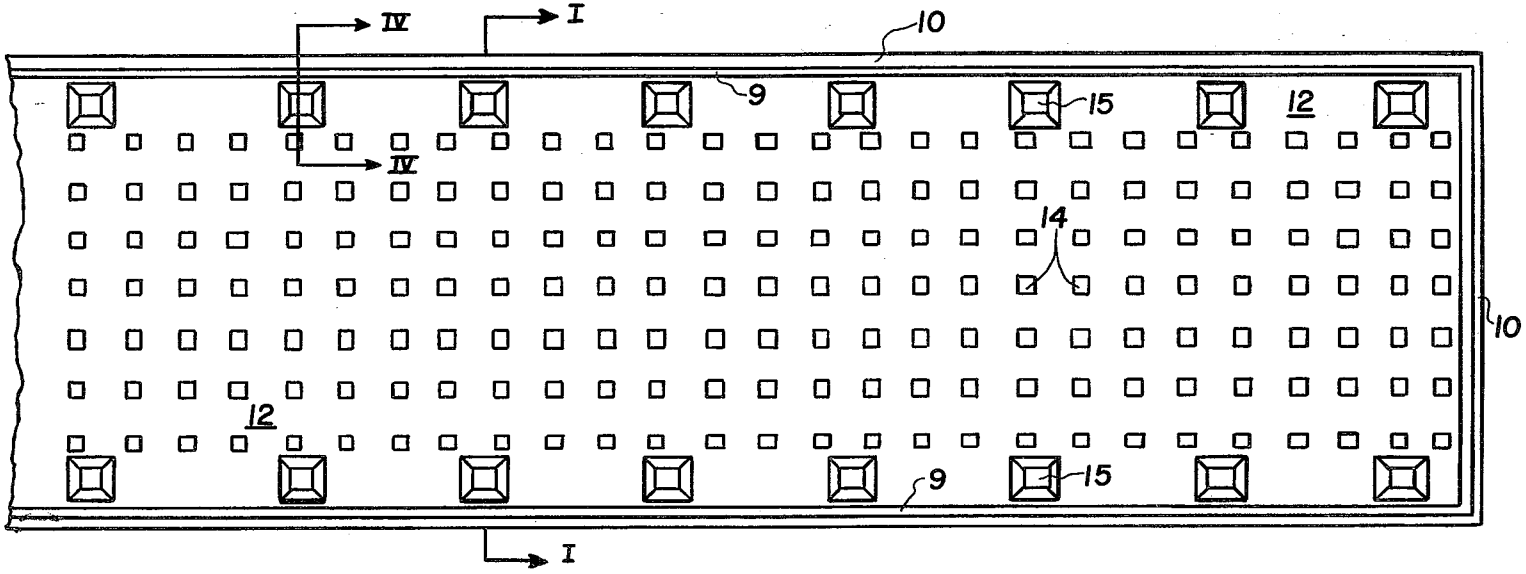
FIG. 3 is a view taken along the line III—III of FIG. 1.

As seen in FIGS. 2 and 3, as well as FIG. 1, the coke oven 1 includes inner supporting angle piece walls 9 and outer supporting angle piece walls 10. A battery mounting plate 11 is provided across the width of the battery for supporting the structure and is positioned over a foundation base or pile plate 12. Pile plate 12 is connected to the ground and is supported by piles 13, which extend into the ground. Mounting plate 11 includes a plurality of lengthwise extending ribs **7*a* and the mounting plate 11 is associated with the baseplate 12 through a plurality of sliding installations or devices, generally designated 114. These sliding devices are shown in greater detail in FIGS. 7 through 9** and may comprise roller bearings or sliding plates.

Ferroconcrete or concrete pegs 15 are bonded to the bottom or foundation baseplate 12 and project upwardly into openings 16 in the mounting plate 11. Elastic elements, generally designated 117, are connected between the upstanding pegs 15 and the edges of the openings 16 to resist transverse and lateral displacement of the mounting plate 11 with respect to the baseplate 12. Slide devices 114 permit the transverse and lateral displacement of the mounting plate 11 with respect to the baseplate 12. Elastic elements 17 are shown in more detail in FIGS. 4 through 6. Master passage bottom 18 is provided at either side of the coke oven battery 1.

Figure 4:
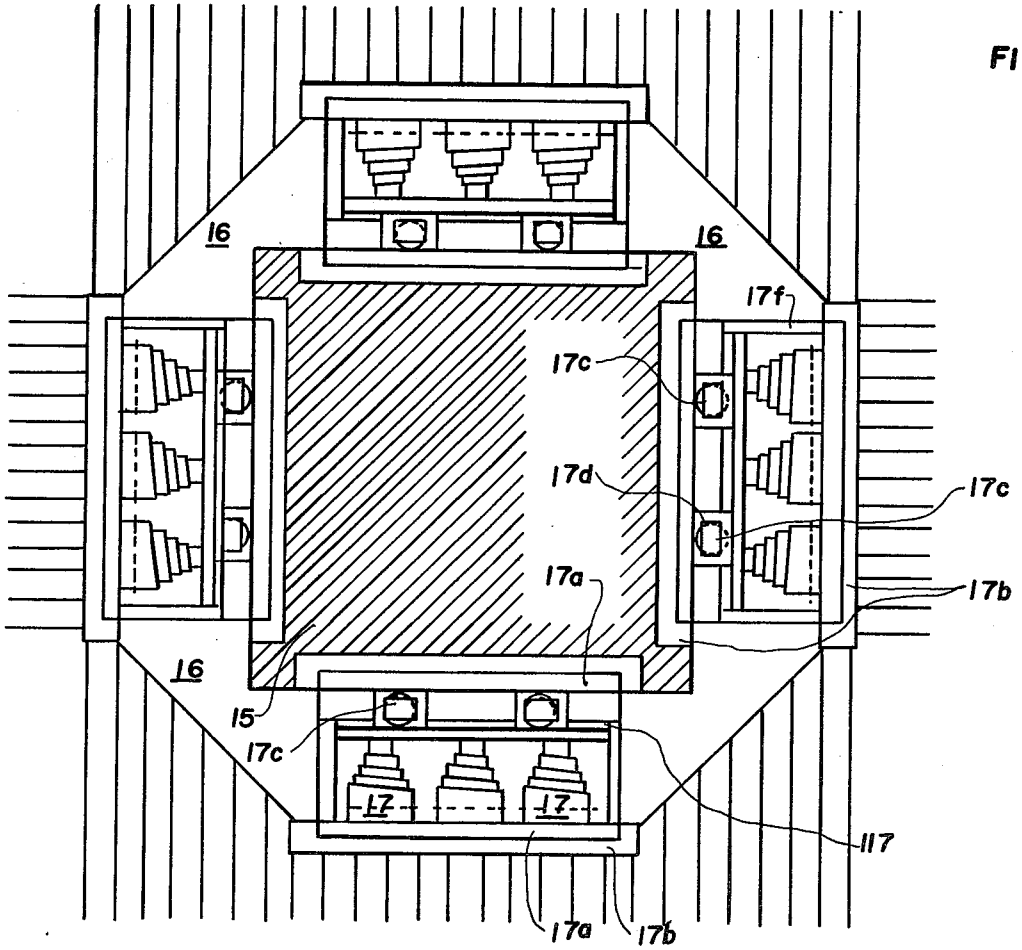
FIG. 4 is an enlarged top view of a spring installation between foundation base and foundation mounting plates.
Figure 5:
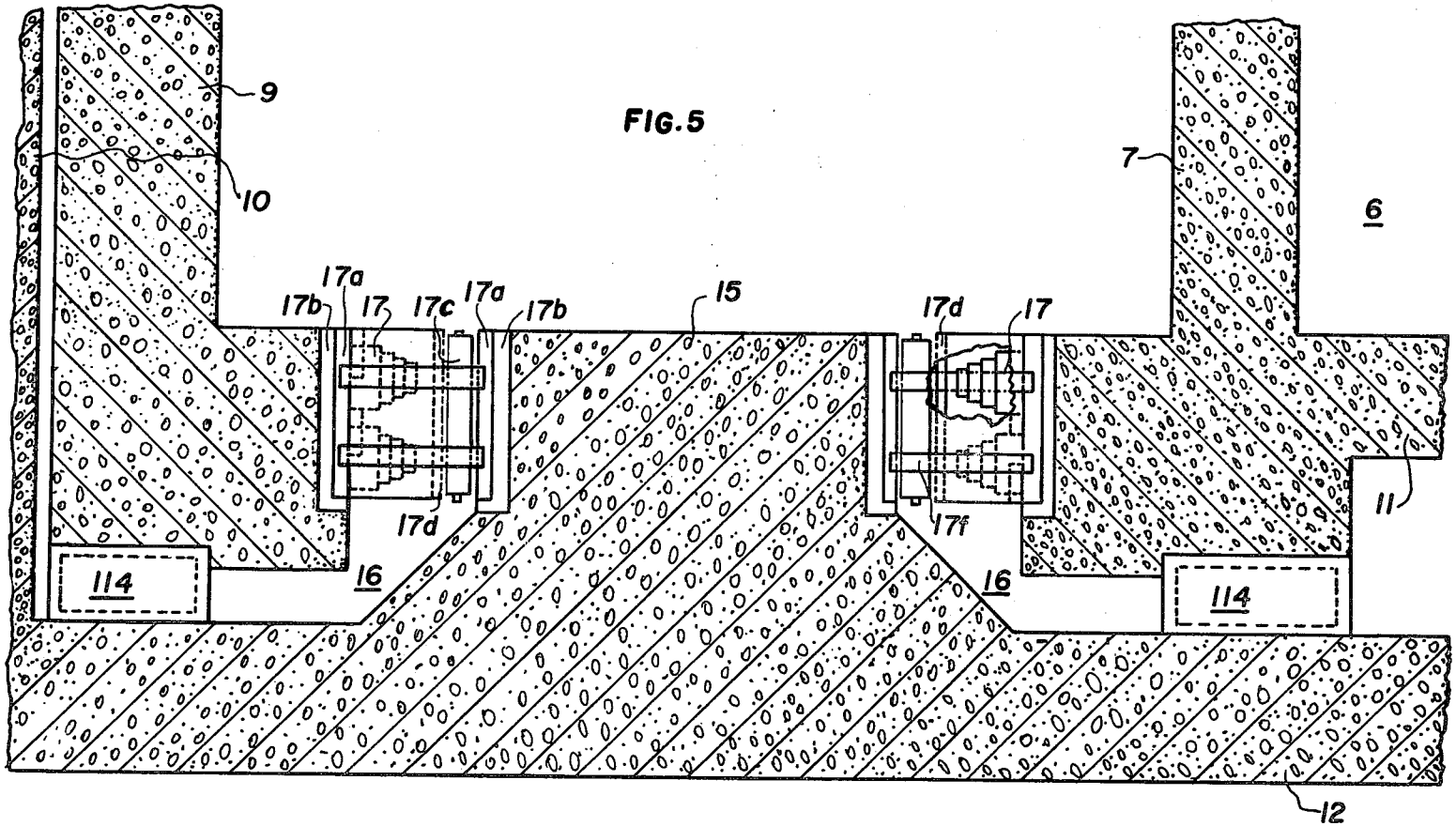
FIG. 5 is a view taken along line V—V of FIGS. 3 and 4.

In FIGS. 4 and 5, the spring installation 117 is shown mounted between the edges of openings 16 in battery mounting plate 11 and the concrete pegs 15 in pile plate 12. Spring installation 117 comprises buffer springs 17 having spring plates **17*a*, anchor plates 17*b*, rolls 17*c*, roll holders 17*d* and spring-lengthwise holders 17*e*, plus lateral or cross-spring holders 17*f***.

Figure 6:
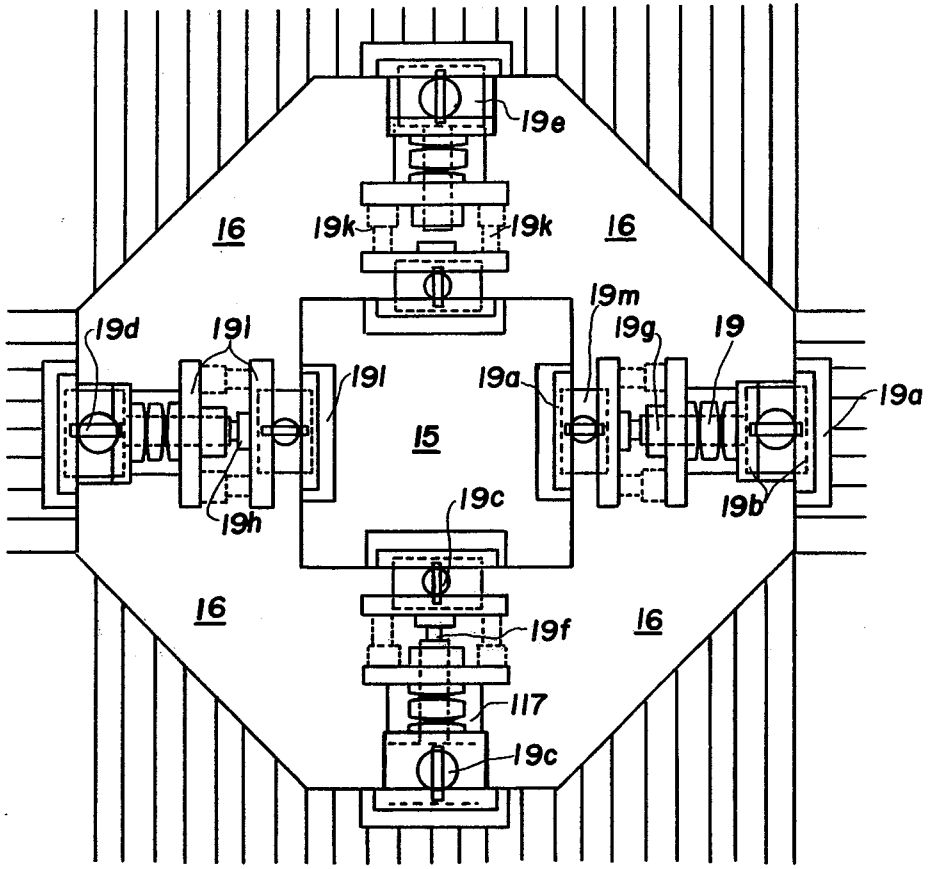
FIG. 6 is a top plan view of another type of spring installation between the foundation base and the foundation mounting plates, constructed in accordance with the invention.

In FIG. 6, the spring installation 117 consists of cup and saucer springs 19 between edges of openings 16, and the concrete pegs 15. Anchor plates 19*a* are arranged on edges of the openings 16 and the concrete pegs 15 to support springs 19*a*. Concrete plates 19*b* are used for anchoring the rollers 19*a*. Furthermore, rollers 19*c* are retained by bottom and top holders 19*d*. Additional parts are spring spindles 19*f*, spindle nuts 19*g*, spindle sleeves 19*h*, prestress plates 19*i*, and hydraulic presses 19*k*. The operation of these devices serve to prestress the cup and saucer springs 19 and are of conventional design. Rollers 19*c* can be mounted in sealed sheet metal box 19*m* which is filled with grease.

Figure 8:
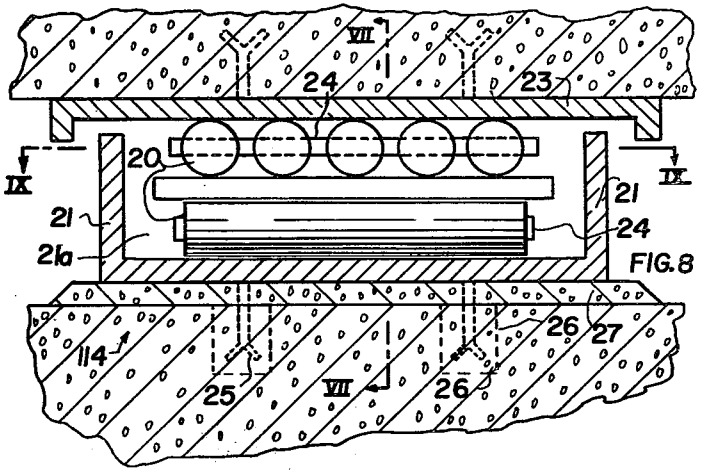
FIGS. 7 through 9 show a cross-roller bearing design partly as projection and partly as cut, used as a common bearing between the foundation baseplate and the foundation mounting plate, whereby.
Figure 7:
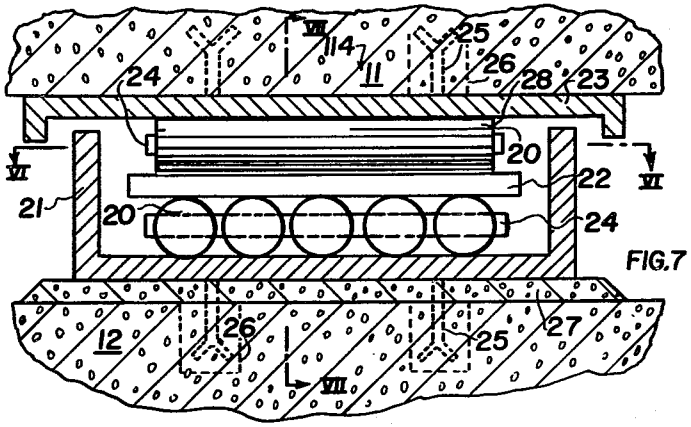
Figure 9:
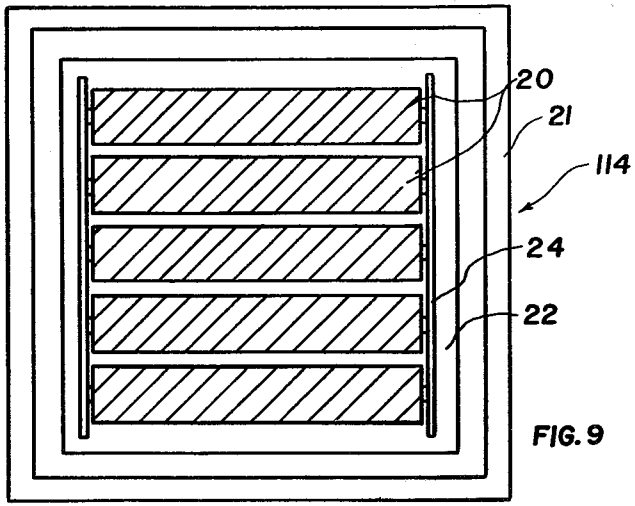

The cross-roller bearings, generally designated 114, of FIGS. 1 and 5, are shown in more detail in FIGS. 7 through 9. Bearing rollers, designated 20, are arranged in a longitudinal and transverse direction in roller box 21 being developed tight-sealed as housing. An intermediate plate 22 is arranged between both roller bearings. The upper sealing plate of roller box 21 is designated 23. Roller holders 24 interact with roller screws 28. Roller box 21 and its upper sealing plate 23 are anchored in anchor holes 26 of battery mounting plates 11 and pile plate 12 via stay anchors 25. A substrate 27 is located beneath roller boxes 21 for supporting the boxes.

Figure 10:
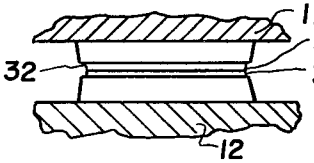
FIG. 10 is a side sectional view, similar to FIG. 7, of another embodiment for the sliding device in accordance with the invention.

Referring now to FIG. 10, an embodiment for the slide device is shown which comprises juxtaposed sheet metal layers 30 and 31 which are preferably made of zinc with a lubricant such as flaked graphite 32 interposed therebetween. Layers 30 and 31 are mounted to mounting plate 11 and baseplate 12, respectively, and provide for the required transverse and lateral displacement of mounting plate 11 with respect to baseplate 12.

Figure 11:
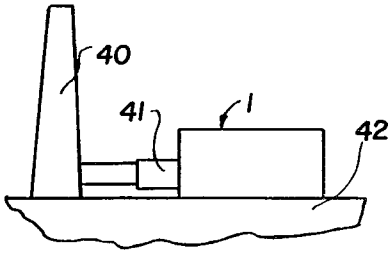
FIG. 11 is a schematic representation of the steel bellows used to connect the chimney with the coke oven battery of the invention.

Referring now to FIG. 11, the steel bellows 41 is shown connected between a chimney 40 and the elastically mounted coke oven battery 1. This steel bellows 41 provides for displacement of the coke oven battery with respect to the chimney in case of the horizontal displacement ground 42 due to an earthquake.

While specific embodiments of the invention have been shown and described in detail to illustrate the application of the principles of the invention, it will be understood that the invention may be embodied otherwise without departing from such principles.

What is claimed is:

1. A coke oven battery with earthquake resistant foundation comprising:

a coke oven assembly (1) having a mounting plate (11);

a plurality of longitudinal ribs (*7a*) extending from a bottom of said mounting plate (11);

a base plate (12) fixedly connected to the ground;

a plurality of sliding elements (114) connected at spaced locations between said base plate and said ribs for permitting transverse and lateral movement of said assembly on said base plate;

said mounting plate including a plurality of spaced openings (16) therein longitudinally distributed adjacent longitudinal sides of said mounting plate;

a ferroconcrete peg (15) extending upwardly from said base plate and into each of said openings; and a plurality of elastic elements (117) connected between each of said pegs and sides of each of said openings to elastically restrain lateral and transverse movement of said mounting plate;

each of said elastic elements comprising an anchor plate connected to a side of said opening, a spring plate connected to said anchor plate, a plurality of buffer springs connected to said spring plate and extending toward said peg, a roller plate connected to said plurality of buffers springs, at least one roller rollable on said roller plate on a side of said roller plate opposite from said plurality of buffer springs, said roller rollable on an axis substantially perpendicular to the transverse and lateral movement of the coke oven assembly, an additional spring plate on which said at least one roller is rollable and an additional anchor plate connected to said peg and to said additional spring plate.

2. A coke oven battery with earthquake resistant foundation according to claim 1, wherein said which springs which are prestressed to permit a lateral and transverse movement of said mounting plate with respect to said base plate of between about ten to twenty mm.

3. A coke oven battery with earthquake resistant foundation according to claim 2, wherein said springs are prestressed to apply a maximum force between said pegs and said openings not exceeding one fifteenth of a weight of said coke oven assembly.

4. A coke oven battery with earthquake resistant foundation according to claim 1, wherein each of said slide elements comprise a first planar plate connected to a bottom of said mounting plate, a first plurality of parallel connected rollers rollable in at least one of the transverse and lateral directions on said first planar plate, an intermediate plate rollable on said first plurality of rollers, a second plurality of parallel connected rollers rollable in the other of the transverse and lateral directions on said intermediate plate and a second planar plate connected to a top of said base plate on which said second plurality of rollers is rollable.

5. A coke oven battery with earthquake resistant foundation according to claim 4, wherein said second planar plate includes upwardly extending side walls for shielding said first and second plurality of rollers.

6. A coke oven battery with earthquake resistant foundation according to claim 1, further including a smokestack fixedly connected to the ground and a bellows for the passage of gases connected between said smokestack and said coke oven assembly.

7. A coke oven battery with earthquake resistant foundation according to claim 1, wherein each of said openings are octagonal in shape, each of said pegs are square in shape and said elastic elements extend between alternate sides of said opening and each side of said peg.

8. A coke oven battery with earthquake resistant foundation comprising:

a coke oven assembly (1) having a mounting plate (11);

a plurality of longitudinal ribs (*7a*) extending from a bottom of said mount plate (11);

a base plate (12) fixedly connected to the ground;

a plurality of sliding elements (114) connected at spaced locations between said base plate and said ribs for permitting transverse and lateral movement of said assembly on said base plate;

said mounting plate including a plurality of spaced openings (16) therein longitudinally distributed adjacent longitudinal sides of said mounting plate;

a ferroconcrete peg (15) extending upwardly from said base plate and into each of said openings; and a plurality of elastic elements (117) connected between each of said pegs and sides of each of said openings to elastically restrain lateral and transverse movement of said mounting plate;

each of said elastic elements comprising an anchor and spring plate connected to a side of said opening and said peg respectively, a roller rollable on an axis substantially perpendicular to said transverse and lateral movement of said coke oven assembly, a prestress plate rollable on each of said rollers and cup and saucer springs between said prestress plates.

9. A coke oven battery with earthquake resistant foundation according to claim 8, wherein each of said elastic elements further includes a hydraulic press connected between said cup and saucer spring and at least one of said prestress plates.

10. A coke oven battery with earthquake resistant foundation according to claim 8, wherein said springs are prestressed to permit a lateral and transverse movement of said mounting plate with respect to said base plate of between about 10 to 20 mm.

11. A coke oven battery with earthquake resistant foundation according to claim 10, wherein said springs are prestressed to apply a maximum force between said pegs and said opening not exceeding 1/15th of a weight of said coke oven assembly.

12. A coke oven battery with earthquake resistant foundation according to claim 8, wherein each of said slide elements comprise a first planar plate connected to a bottom of said mounting plate, a first plurality of parallel connected rollers rollable in at least one of the transverse and lateral directions on said first planar plate, an intermediate plate rollable on said first plurality of rollers, a second plurality of parallel connected rollers rollable in the other of the transverse and lateral directions on said intermediate plate and a second planar plate connected to a top of said base plate on which said second plurality of rollers is rollable.

13. A coke oven battery with earthquake resistant foundation according to claim 8, further including a smoke stack fixedly connected to the ground and a bellows for the passage of gases connected between said smoke stack and said coke oven assembly.

14. A coke oven battery with earthquake resistant foundation according to claim 8, wherein each of said openings are octagonal in shape, each of said pegs are square in shape and said elastic elements extend between alternate sides of said opening and each side of said peg.

* * * * *